United States Patent [19]

Wells et al.

[11] Patent Number: 4,593,659

[45] Date of Patent: Jun. 10, 1986

[54] ENGINE VALVE COVER

[75] Inventors: Larry Wells; Karl Graham, both of Columbus, Ind.

[73] Assignee: Cummins Engine Company, Inc., Columbus, Ind.

[21] Appl. No.: 749,744

[22] Filed: Jun. 28, 1985

[51] Int. Cl.[4] ..... F01M 9/10

[52] U.S. Cl. ..... 123/90.38; 123/195 C

[58] Field of Search ..... 123/90.38, 195 C, 198 E

[56] References Cited

U.S. PATENT DOCUMENTS

| | | | |
|---|---|---|---|
| 1,484,267 | 2/1924 | Hull et al. | 123/90.38 |
| 1,728,149 | 9/1929 | Berne | 123/90.38 |
| 2,427,288 | 9/1947 | Kraker | 123/90.38 |
| 2,607,331 | 8/1952 | Wefing | 123/90.38 |
| 3,063,439 | 11/1962 | Kessel | 123/90.38 |
| 4,027,644 | 6/1977 | Timour | 123/198 E |
| 4,164,927 | 8/1979 | Congram et al. | 123/195 C |
| 4,471,731 | 9/1984 | Kasting et al. | 123/90.38 |

FOREIGN PATENT DOCUMENTS

| | | | |
|---|---|---|---|
| 499667 | 1/1939 | United Kingdom | 123/90.38 |

*Primary Examiner*—Ira S. Lazarus

*Attorney, Agent, or Firm*—Sixbey, Friedman & Leedom

[57] ABSTRACT

A valve cover for an internal combustion engine has a cover body of an inverted trough-like configuration and a perimetric flange surrounding its open bottom side. A seal receiving groove is formed in a bottom surface of the perimetric flange and extends more than one full circuit around the perimeter of the open side. An elongated elastomeric seal strip of a length that is greater than the circumference of the cover body, as measured within the seal receiving groove, is inserted into the seal receiving groove in a manner wherein opposite ends of the seal strip are overlapped side-by-side and wherein the bottom of the seal strip extends out of the seal receiving groove in a manner forming a sealing ridge around the bottom of the perimetric flange of the cover body. Furthermore, through the provision of O-ring seals on thread fastening bolts used for securing the cover body to an engine, in conjunction with the elastomeric seal strip, the valve cover is able to minimize the production of engine vibration related noise. Additionally, an arrangement of partition walls, ribs, and columns is utilized to distributing loading applied by a row of top mounted fastening bolts uniformly throughout the periphery of the valve cover and a pair of the partition walls are also utilized to form an isolated chamber for a breather vent connection.

20 Claims, 8 Drawing Figures

ENGINE VALVE COVER

TECHNICAL FIELD

The present invention relates to valve covers for use with internal combustion engines and more particularly, to an improved valve cover which surrounds and protects the cylinder valve assemblies and rocker arm mechanisms mounted on the engine cylinder head.

BACKGROUND ART

In designing a valve cover, it is important to provide the valve cover with sufficient strength and adequate sealing capabilities while, at the same time, addressing the problem of damping noise-producing vibrations and the problem of producing the cover at as low a cost as possible. In this regard, while there are many adequate valve covers in existence, they all have one or more shortcomings in relation to the above indicated factors of strength, sealing, vibration damping and cost minimization.

U.S. Pat. No. 4,164,927, to Congram et al discloses a reinforced stamped metal valve cover in the form of an elongated trough-like configuration that is stamped from a single sheet of metal. For strength purposes, generally U-shaped strengthening members are attached to the underside of the housing. The legs of the U-shaped strengthening members extend the full height of the trough-like housing and the legs are connected by a portion of the U-shape that extends across the bottom wall of the trough-like shape (underside of the top wall of the cover). These strengthening members are positioned at four locations, two near each longitudinal end of the housing, and the free ends of their legs coact with a flange-like leg of the housing side walls to form receiving pockets for a conventional ring-like gasket. The cover is secured to the rocker housing by nuts that are threaded onto threaded studs which extend upwardly from the rocker arm mounts through holes in the top wall of the valve cover.

However, such a valve cover has a number of drawbacks. Firstly, the cost of manufacturing such a stamped valve cover is increased by virtue of the fact that the four strengthening members must be separately welded onto the housing part. Furthermore, since loading of a flat gasket will produce spreading in a direction perpendicular to the direction in which the load is applied, the fact that the gasket of the Congram et al valve cover is restrained against inward spreading at only four points will enable non-uniform spreading of the gasket when the valve cover is secured in place. This problem is compounded by the lack of any strengthening members in the longitudinally central area of the housing which enables the longitudinally extending side walls to spread apart under action of the securing force pressing down on the top of the trough-like housing. As a result, it cannot be insured that an adequate sealing pressure will exist around the entire periphery of the cover and thus oil leakage across the gasket seal can become a problem.

Additionally, since there is a direct metal-to-metal interface between the engine and stamped metal valve cover in the Congram et al arrangement, a conventional metal ring washer being the only interface between the top of the valve cover and the fastening nut threaded onto the rocker mounted stud, noise-producing vibrations will be a problem even though an elastomeric gasket interface exists between the peripheral bottom edge of the valve cover and the top surface of the head upon which it is mounted.

In Timour U.S. Pat. No. 4,027,644, assigned to the assignee of the present invention, an isolated engine cover is disclosed wherein the problem of damping noise-producing vibrations is specifically addressed. Timour utilizes a continuous, vertically elongated, elastomeric seal element which extends from a groove formed around the periphery of the engine cover in conjunction with mounting bolts having resilient fastener assemblies in order to prevent any direct or indirect transfer of vibrations between the engine and the cover. Although the arrangement of this patent provides an adequate means for diminishing the noise emanating from the cover for the rocker arms, it is subject to oil leakage. That is, the width of the vertically elongated elastomeric element which seals the periphery of the cover is not sufficient to prevent oil leakage thereacross during periods of heavy engine vibration.

In order to provide a more substantial sealing arrangement around an engine cover for a rocker housing, in Kasting et al, U.S. Pat. No. 4,471,731, also assigned to the assignee of the present invention, the vibration damping concept of Timour is further developed in conjunction with a plastic rocker arm cover in order to achieve an effective sealing arrangement as well as effective noise damping capacity. In particular, the plastic rocker cover is secured about its periphery by a plurality of vibration-damping bolt assemblies with oil leakage being minimized by a flat ring-like gasket being inserted between the rocker housing and the rocker cover and with a drip lip extending around the inner periphery of the cover so as to bite into the gasket when the bolt assemblies are tightened in order to increase the sealing capacity of the gasket. Additionally, for strengthening purposes, the cover of the Kasting et al patent has longitudinal and lateral reinforcing ribs on its undersurface.

While the Kasting et al rocker cover provides an effective leak-proof, noise-damped cover arrangement, it is relatively expensive. That is, because the cover is peripherally secured by bolts, a relatively large number of bolts (14 in the illustrated embodiment) is required and its vibration damping structure requires that each securing bolt be surrounded by a steel sleeve which is in turn surrounded by a custom-molded elastomeric grommet that is inserted into the bolt holes in the peripheral flange of the cover.

In addition to the above-noted facts, it is pointed out that continuous annular gasket seals require proper positioning and precision manufacture and if they are stamped from a sheet they produce excessive waste while the cost of production is relatively high if molded. Furthermore, continuous, annular gasket seals are normally formed of a silicon rubber and are not reusable because of the fact that, upon exposure to oil, the rubber material swells so that, if the valve cover is removed, the seal expands longitudinally and will no longer fit. Thus, the fact that the gasket seal must be replaced any time the valve cover is removed is another disadvantage of known valve cover arrangements.

DISCLOSURE OF INVENTION

In view of the foregoing, it is apparent that there still is a need for a valve cover which will provide both effective sealing and noise-damping along with adequate strength, yet will not be unnecessarily expensive.

It is, therefore, an objective of the present invention, to provide a valve cover that is strong, provides effective sealing and noise damping, and achieves the same at a minimized cost.

It is a specific object of the present invention to provide a valve cover that utilizes an inexpensive and reusable gasket sealing construction.

A further object is to obtain an isolated valve cover arrangement for achieving noise damping that utilizes a minimum number of cover mounting bolts and does not require custom manufactured bolt surrounding grommets, sleeves, or the like.

It is yet another object of the present invention to ensure an effective sealing of the valve cover by substantially uniformly distributing the load applied by top mounted bolts about the peripheral edge along which sealing occurs.

Still another object in accordance with the present invention it to provide the valve cover with a breather hole requiring no specially added baffles or the like.

Yet a further object in accordance with the present invention is to enable the formation of a cast cover with all reinforcing ribs, partition panels and a threaded filler hole being unitarily cast parts thereof.

In accordance with the above objects, a preferred embodiment of a valve cover for an internal combustion engine comprises a cover body of an inverted trough-like configuration having a top wall, opposed elongated side walls and opposed end walls, as well as a perimetric flange surrounding an open bottom side of the inverted trough-like configuration. The flange of the cover body is provided with a seal receiving groove formed in a bottom surface thereof and extending for more than one full circuit around the perimeter of the open end of the cover body. An elongated elastomeric strip having a length that is greater than the circumference of the cover body, as measured within the seal receiving groove, is inserted within the seal receiving groove in a manner so that opposite ends of the elongated seal strip are overlapped in side-by-side relationship and wherein the bottom of the seal strip extends out of the seal receiving groove so as to form a sealing ridge around the bottom of the perimetric flange.

For mounting the valve cover on a head of an engine, a row of through-holes are positioned centrally along the top wall of the inverted trough-like cover body. Shoulder bolts having a shoulder that limits the extent to which they can be tightened are provided for insertion through each of the through-holes into engagement with the engine head, and an elastomeric O-ring seal is mounted about the fastening means, under a head of the shoulder bolt, in a manner that enables sealing of the clearance gap between the top wall of the cover body and the head of the shoulder bolt to be achieved. Additionally, the O-ring seals, in conjunction with the supporting of the cover upon the sealing ridge created by the elongated seal strip, serves to isolate the cover body from engine vibrations, thereby providing the valve cover with excellent noise damping characteristics.

Furthermore, in order to provide a means for distributing the securing forces applied to the valve cover by the fastening means substantially uniformly along the elongated sealing strip, several steps have been taken. Firstly, a plurality of reinforcing ribs radiate from the through-holes in generally longitudinal and lateral directions with respect to the cover, and have a relatively small height in comparison to the height of the cover body. Longitudinally oriented ones of the reinforcing ribs terminate at vertical partition walls which extend between the elongated side walls in a manner interconnecting these side walls, at least at a bottom portion of the side walls. Still further, one of the elongated side walls, at locations corresponding to injector nozzle bosses, is provided with relatively deep, outwardly open, U-shaped vertical columns that extend the full height of the cover body, while the opposite elongated side wall is formed with relatively shallow, outwardly open, U-shaped vertical columns that extend the full height of the cover body. The laterally oriented ones of the reinforcing ribs radiate from the through-holes to only the elongated side wall formed with the relatively shallow U-shaped vertical columns, these relatively shallow U-shaped vertical columns being longitudinally aligned with an end of the partition walls, while the relatively deep U-shaped vertical columns are centrally positioned with respect to rocker-arms receiving chambers created by the partition walls.

A pair of the partition walls are also used to create a small, isolated space which can be utilized as a breather space by providing an opening for a breather vent connection in the top wall of the valve cover above this isolated space. Also, one of the partition walls can be modified in configuration so as to provide a threaded oil fill port.

These and further objects, features and advantages of the present invention will become more obvious from the following description when taken in connection with the accompanying drawings which show, for purposes of illustration only, a single embodiment in accordance with the present invention.

BEST MODE FOR CARRYING OUT THE INVENTION

Figure 1:
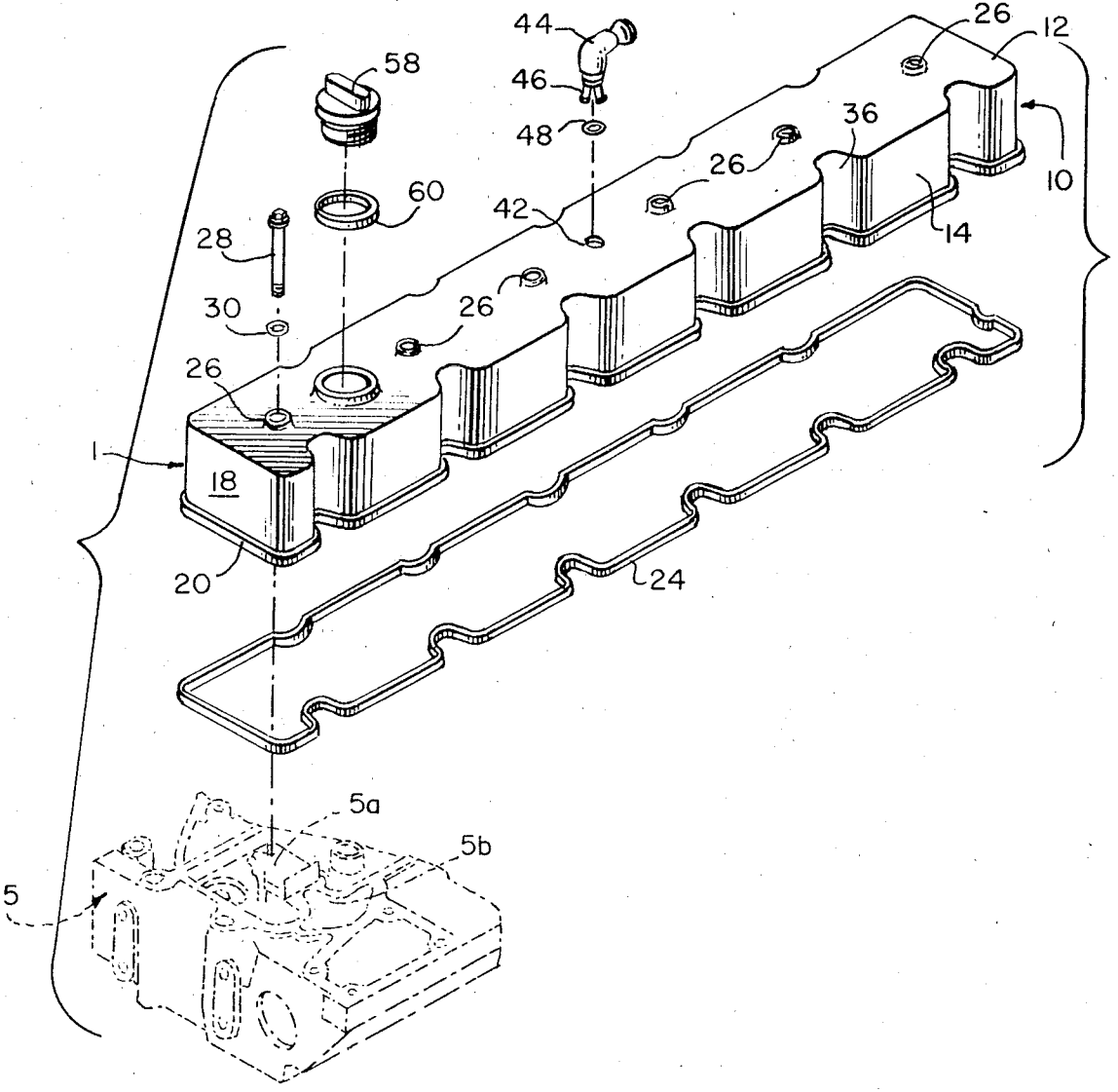
FIG. 1 is an exploded perspective view of a valve cover in accordance with a preferred embodiment of the invention with a portion of an engine cylinder head being shown in phantom outline.

In FIG. 1, a valve cover, indicated generally by the reference numeral 1, for mounting upon a cylinder head of an internal combustion engine 5 (a portion of which is shown in phantom) is illustrated. The valve cover 1 is, in use, mounted on top of the cylinder head for the purpose of covering the top ends of the cylinder valves as well as the rocker arms and push rods utilized to operate these valves.

The first component of the illustrated valve cover is the cover body 10 that is formed of an inverted trough-like configuration having a top wall 12, a pair of opposed elongated side walls 14, 16, and opposed end walls 18. Additionally, a perimetric flange 20 surrounds the open bottom side of the cover body 10 and is provided with a seal receiving groove 22 in a bottom side thereof (i.e., the side which, in use, faces toward the head 5). The seal receiving groove extends more than one full circuit around the perimeter of the open end of the cover body so that an overlap zone 22*a* is formed that is twice as wide as the width of the remaining portion of the groove 22.

An elongated elastomeric seal strip of, for example, silicon rubber, is provided as a gasket seal for the junction between the valve cover 1 and the cylinder head 5. Seal strip 24 has a length that is greater than the circumference of the cover body, as measured within the seal receiving groove 22. Use of an elastomeric seal strip is advantageous with respect to the conventionally used continuous annular type gasket in that it can be produced more inexpensively by being created simply of a predetermined length cut from an indefinite length extruded strip. In view of the fact that the seal strip 24 has a length that is greater than the circumference of the cover body measured within the seal receiving groove 22, it is inserted into sealing groove 22 in a manner wherein opposite ends 24*a*, 24*b* are overlapped in side-by-side relationship within the double width overlap zone 22*a* of seal receiving groove 22. Because of the fact that such a seal strip will expand in a plane perpendicular to the direction in which loading is applied, when sealing pressure is applied to strip 24 in a vertical direction, the overlapped end portions 24*a*, 24*b*, which are prevented from expanding away from their overlapped sides by the side walls of groove 22, will expand towards each other resulting in a tightly sealed interface therebetween through which oil will not leak. In this regard, it is noted that the minimum required length of overlap between end portions 24*a*, 24*b* is on the order of ⅜ to ½ inch, but can be longer if so desired. Furthermore, while the overlapped end portions 24*a*, 24*b*, are shown as being situated in the longitudinal center of the flange portion located at side 16 of cover body 10, the area of overlap can be situated at any desired point along flange 20.

Another advantage attributable to the use of a elongated strip instead of a continuous annular gasket is that seal strip 24 of the present invention is reusable while continuous annular gaskets are not. That is, silicon rubbers of the type conventionally used for continuous annular gaskets and as used for the seal strip 24 of the present invention have the inherent characteristic that they swell in length when exposed to oil. Thus, when a valve cover equipped with a continuous annular gasket is removed, such as for a pair of the rocker arms, the annular gasket will expand to an extent rendering it unusable. On the other hand, if the seal strip 24 of the present invention expands to a length that is greater than that receivable within the seal receiving groove 22, its length need only be trimmed back to a length which will fit, with its ends overlapped, within the seal receiving groove 22. Still further, in addition to the advantages of being of lower cost and reusable construction, the discontinuous elastomeric seal strip is simpler to install, lacking the precise positioning requirements of an irregularly shaped, continuous annular gasket.

Movement of pistons, rods, rockers and like parts of an engine produce excitation forces which, if transmitted to valve cover 1, would cause the valve cover 1 to vibrate, in turn, would result in the valve cover emitting noise in the manner of a speaker diaphragm. To avoid such a problem, a means for mounting the valve cover on a head of an engine is provided which will completely isolate valve cover 1 with respect to the engine, thereby greatly minimizing the amount of noise emitted. To this end, the valve cover is provided with leak-proofing seals that prevent metal-to-metal contact between cover 10 and parts which otherwise could serve to transmit engine vibrations thereto.

Figure 3:
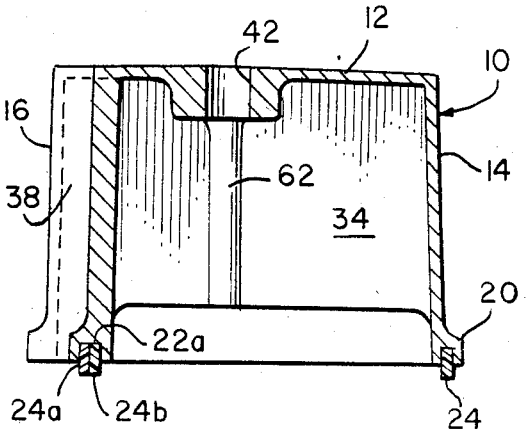
FIG. 3 is a cross-sectional view of the valve cover taken along line A—A of FIG. 2.

Firstly, as can be seen from FIG. 3, the elastomeric seal strip is constructed of a thickness that is great enough to extend out of the seal-receiving groove so as to form a sealing ridge around the bottom of flange 20 and to an extent that will ensure that when a force is applied to the cover body 10 sufficient to produce adequate sealing force along the full extent of seal 24, a small clearance gap will still exist between the bottom surface of flange 20 and the facing surface of head 5.

The cover body 10 is mounted, and appropriate sealing pressure applied upon head 5, by providing a row of through-holes 26 centrally along the top wall 12 of cover body 10. Threaded fastening means 28 are inserted through each of the through holes 26 into threaded engagement with the head 5 at, for example, rocker mounts 5*a*. In this regard, it is advantageous for the threaded fastening means 28 to be shoulder bolts having a shoulder that will limit the extent to which they can be tightened into the head and a length that is coordinated to the height of the valve cover body for enabling the noted clearance gap to be maintained between the bottom side of flange 20 and the facing surface of head 5 in their fully tightened condition. Additionally, the use of shoulder bolts ensures that a sufficient tightening force can be applied without the need for the use of torque indicating wrenches, metal sleeves, spring arrangements or the like.

Figure 4:
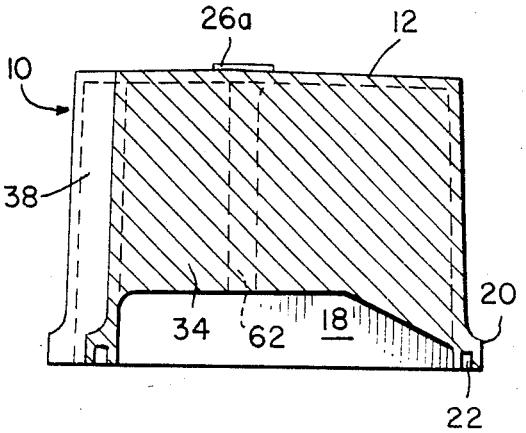
FIG. 4 is a cross-sectional view of the valve cover taken along line V—V of FIG. 2, but with the gasket strip omitted.

Furthermore, inasmuch as use of only a conventional metal flat washer between the head of each bolt 28 and the top of the cover body 10 would create problems of oil leakage and noise-producing vibrations being transmitted from the engine to the cover body 10 via the bolts 28, in accordance with the present invention, a conventional silicon rubber O-ring 30 is mounted around the shaft of each shoulder bolt 22. The elastomeric O-ring seals 30, when the bolts 28 are tightened, will engage in seats 26*a* of the throughholes 26 in a manner sealing a clearance gap that is created between the top wall 12 of cover body 10 and the underside of the head of shoulder bolts 28 (or a washer that might be disposed between the O-ring seal and the head of the shoulder bolt 28). Moreover, since seat 26*a* projects slightly above top surface 12 (see FIGS. 4 and 5) and the O-ring seal 31, in the tightened condition of the bolts 28, will project above the height of the respective seat 26*a*, metal-to-metal contact between the head of the shoulder bolt and the cover body 10 will be prevented, thereby isolating the cover body 10 against transmission of vibration from the engine via the shoulder bolts 28.

The use of a single, centrally positioned, row of top-mounted fastening bolts 28 is advantageous with respect to the use of fastening bolts distributed about the perimetric bottom flange in that the flange can then be made narrower and less than half as many bolts are required. On the other hand, when only a few (6 in the illustrated embodiment) fastening bolts 28 apply force to the valve cover along a central line at its top surface, that force may not be uniformly distributed to the perimetric flange 20 so that the gasket, formed by the elongated elastomeric seal strip 24, may not experience sufficient vertical loading at one or more locations which then results in the creation of potential leak paths for oil. For this reason, the following measures have been taken for distributing the securing forces applied to the cover body 10 by the fastening bolts 28 substantially uniformly along the elongated sealing strip.

Figure 2:
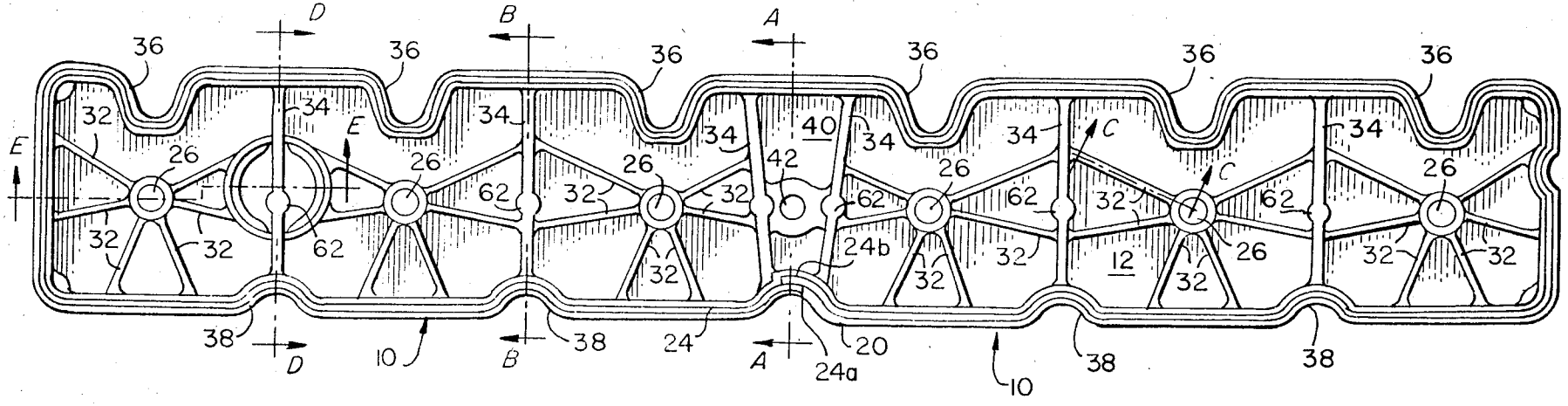
FIG. 2 is a bottom plan view of the valve cover of FIG. 1 with the gasket strip inserted.
Figure 5:
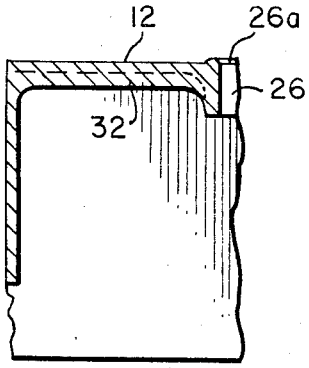
FIG. 5 is a sectional view taken along line C—C of FIG. 2, but with the gasket strip omitted.
Figure 6:
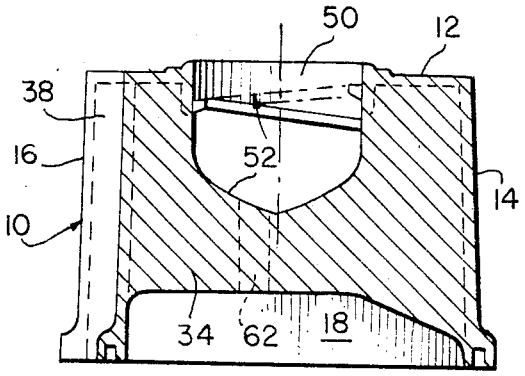
FIG. 6 is a cross-sectional view taken along line D—D of FIG. 2, but with the gasket strip omitted.
Figure 7:
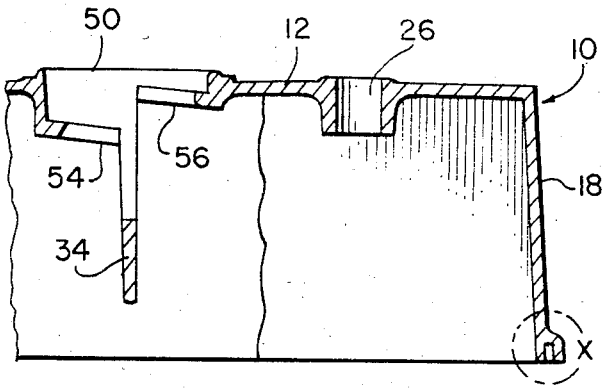
FIG. 7 is a sectional view taken along the line E—E of FIG. 2, but with the gasket strip omitted.

Firstly, as can be seen from FIG. 2 of the drawings, a plurality of reinforcing ribs 32 radiate from each of the through-holes 26 in generally longitudinal and lateral directions with respect to the cover body 10. As can be seen in FIG. 5, the reinforcing ribs 32 have a relatively small height in comparison to the height of cover body 10. In addition to reinforcing the top wall 12 of cover body 10, these ribs 32 serve to transfer the loading supplied by the bolts 28 along their length.

Additionally, vertical partition walls 34 are provided extending between the opposed elongated longitudinal side walls 14, 16 in a manner that interconnects the side walls at least at a bottom portion thereof. From a practical standpoint, however, even though it is sufficient that the partitions extend only across a bottom portion of the interior space of the cover body 10, from a manufacturing standpoint it is simpler merely to have the partitions 34 extend from the bottom portion all the way up to the top wall 12. These partitions 34 tie the side walls 14, 16 together in a manner countering the tendency which would exist for these walls to spread apart under action of the load applied by the bolts 28 to the top center of cover wall 12. It can also be seen from FIG. 2 that the partition walls 34 are connected to the ends of respective pairs of longitudinally oriented reinforcing ribs 32 so that loading transferred from the bolt along these pairs of ribs will be transferred to the partition walls 34.

To further strengthen the cover and distribute the bolt applied forces about the circumferential flange, the elongated side walls 14, 16 are provided with outwardly open, U-shaped vertical columns formed therein. The vertical columns 36 extend the full height of cover body 10 and are relatively deep, their size and position being coordinated to the injector nozzle receiving bosses **5*b* of the illustrated head 5 (FIG. 1). Since such relatively large columns will introduce a column stiffness to the cover body 10 that will act to disproportionately attract the loading applied by the fastening bolts 28, and since it is neither practical nor desirable to provide mirror imaged columns on the opposite wall 16, other means have been taken to counteract the effect of the relatively deep vertical columns 36 of the wall 14**.

Firstly, none of the laterally radiating reinforcing ribs 32 extend to wall 14, and, instead, the illustrated pair of generally laterally oriented ribs 32 extend to wall 16 at locations directly opposite the outer edges of the relatively deep U-shaped columns 36. Furthermore, relatively shallow, outwardly open U-shaped vertical columns extend the full height of the cover body 10 at the locations where the partition walls 34 meet the side wall 16. By locating the partitions and shallow vertical columns 38 at locations which, in use, will be between the valves and rocker arms of the respective cylinders of the engine, these structures require no modifications to the engine design since sufficient space is available at these points.

It will also be apparent from FIG. 2 that, between the central-most pair of through-holes 26, a pair of relatively closely spaced ribs 34 are provided instead of a single rib as is used between the other sets of adjacent through-holes 26. This feature achieves two functions. Firstly, and primarily, the use of a pair of spaced partition walls 34 across the interior of cover body 10, that extend from a bottom portion of the side walls 14, 16 all the way up to the top wall 12, serves to create a chamber 40 that is shielded against oil being splashed therein. Thus, a breather vent opening 42 can be provided in top wall 12 above this chamber and the partition walls flanking chamber 40 will eliminate the need for any add-on baffles. The wedge-like arrangement of the partition walls flanking chamber 40 (FIG. 2) also serves to more effectively distribute the loading applied by the central pair of fastening bolts 28 to the overlap zone **22*a*, thereby ensuring a tight sealing between ends 24*a*, 24*b* of seal strip 24**.

A vent connector 44 of glass filled nylon having snap-in locking fingers 46 may be inserted through a conventional silicon-rubber O-ring seal 48 into the vent opening 42 so as to lock the vent connector 44 within the vent opening 42 in a manner that is sealed against leakage of oil between the vent connector and the vent opening and in a manner which will enable the vent connector 44 to rotate through a full 360 degrees so as to adapt it to any engine configuration.

Figure 8:
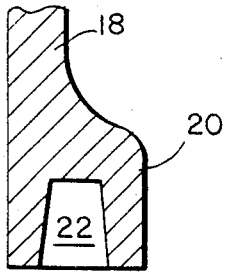
FIG. 8 is an enlarged view of detail X of Figure 7.

As noted initially, it is advantageous for the valve cover of the present invention to be formed with a cover body 10 that is a cast aluminum part to which all of the reinforcing ribs, partitions, and the like are unitarily formed, so as to avoid any additional manufacturing steps, and such is possible with the cover body 10 as described so far. Additionally, while the seal receiving groove 22 may be provided with a rectangular cross-sectional shape, it is advantageous to provide seal receiving groove 22 with the trapezoidal configuration illustrated in FIG. 8. This trapezoidal configuration has oppositely sloping side walls which have a downward and outward slope relative to a vertical plane through their respective junction with the top wall of the trapezoidal cross sectional shape (bottom of groove 22) which forms a 1 degree angle with respect to such a vertical plane. By giving the seal receiving groove 22 such a cross sectional configuration, cores as are required to form the groove 22 in the flange 20 when it is cast, may be easily withdrawn from groove 22 when the cover body 10 is ready to be removed from the mold within which it is cast. In this regard, it is noted that the partition walls are formed with cylindrical column-like formations 62, that may be engaged by ejector pins of the casting mold for removal of the cover body therefrom. Secondarily, since the seal receiving groove should only be slightly smaller in width than the uncompressed width of the elongated elastomeric seal strip 24, this inwardly tapering shape acts to facilitate the ability for the receiving groove 22 to hold the seal strip 24, despite manufacturing tolerances and temperature related expansions and contractions, and is also conducive to improving the sealing effect between the overlapped end portions **24*a*, 24*b***.

In order to enable the valve cover to be cast with a threaded oil fill port, an opening 50 is provided centrally above an end one of the partition walls 34. In the area underneath the fill port opening 50, a well 52 is formed in the top of the partition wall which enables an oil pouring spout to be inserted through the fill port opening 50. Additionally, the portion of the top wall 12 defining the fill port opening 50 is formed with substantially ½ turn thread portions 54, 56. The thread portions 54, 56, thus essentially form one full spiral thread turn which may be utilized to thread a fill port closure cap 58 into the fill port opening 50. An O-ring gasket 60 is provided as a seal means for the fill port closure cap 58.

Such a threaded fill port configuration can be easily cast into the cover body 10 through the use of appropriately configured core members.

INDUSTRIAL APPLICABILITY

A valve cover constructed in accordance with the foregoing description can be advantageously employed with any internal combustion engine. The ability to cast the cover body of the valve cover out of aluminum with all of its partitions and reinforcing ribs, as well as a breather vent chamber and threaded fill ports as unitary parts thereof greatly simplifies manufacture of the valve cover and reduces the associated costs. The use of an elastomeric seal strip as a gasket instead of a continuous annular gasket not only reduces the cost for producing such a gasket, but renders it reusable. Furthermore, provision of O-ring gaskets about the heads of fastening bolts used for securing the valve covers to the head of an engine, in conjunction with the sealing ridge created by the elongated strip gasket for maintaining a clearance between the cover body and the top of the engine, enables the cover body to be isolated against transference of vibration from the engine to the cover, thereby minimizing noise production.

Additionally, the characteristic of the present invention whereby an arrangement of vertical columns, radiating ribs and partition walls are used to transfer loading produced by the fastening bolts about the periphery of the cover body enables the uniform sealing effect, previously only obtainable by a large number of peripherally located bolts, to be achieved by a relatively few top mounted bolts, further reducing costs associated with the present invention. Still further, use of shoulder bolts, as the fastening bolts, makes it ease to obtain the right mounting pressure without the use of a torque indicating wrench, special metal bolt surrounding sleeves, spring arrangements, or the like.

While we have shown and described various embodiments in accordance with the present invention, it is understood that the same is not limited thereto, but is susceptible of numerous changes and modifications as known to those skilled in the art, and we, therefore, do not wish to be limited to the details shown and described herein, but intend to cover all such changes and modifications as are encompassed by the scope of the appended claims.

We claim:

1. A valve cover for an internal combustion engine, comprising:

a cover body of an inverted trough-like configuration having a top wall, opposed elongated side walls and opposed end walls, a perimetric flange surrounding an open bottom side of said inverted trough-like configuration, and a seal receiving groove formed in a bottom surface of said perimetric flange and extending more than one full circuit around the perimeter of said open side;

an elongated elastomeric seal strip having a length that is greater than the circumference of the cover body as measured within said seal receiving groove, said elongated elastomeric seal strip being inserted within said seal receiving groove in a manner werein opposite ends of the seal strip are overlapped side-by-side and the bottom of said seal strip extends out of said seal receiving groove so as to form a sealing ridge around the bottom of said flange; and means for mounting the valve cover on a head of an engine.

2. A valve cover according to claim 1, wherein said means for mounting comprises a row of through-holes positioned centrally on said top wall of said inverted trough-like configuration, threaded fastening means for insertion through each of said through-holes into engagement with the head, and elastomeric O-ring seal means mounted around said fastening means in a manner sealing a clearance gap between said top wall and said fastening means and isolating said cover body against transmission of vibration from said engine via said fastening means.

3. A valve cover according to claim 2, wherein said threaded fastening means are shoulder bolts having a shoulder limiting the extent to which they can be tightened, a head for pressing said O-ring seal against the top wall of cover body and a length coordinated to the height of the cover body for enabling a clearance gap to be maintained between the bottom surface of the perimetric flange and a facing surface of the head in a fully tightened condition of the bolts.

4. A valve cover according to claim 3, further comprising means for distributing securing forces applied by said fastening means substantially uniformly along the elongated sealing strip.

5. A valve cover according to claim 4, wherein the means for distributing includes a plurality of reinforcing ribs radiating from each of said through-holes in generally longitudinal and lateral directions with respect to the cover body, said reinforcing ribs having a relatively small height in comparison to the height of said cover body.

6. A valve cover according to claim 5, wherein the means for distributing also includes vertical partition walls extending between the elongated side walls in a manner interconnecting the sidewalls at least at a bottom portion thereof, longitudinally oriented ones of said reinforcing ribs radiating from said through-holes terminating at said partition walls.

7. A valve cover according to claim 6, wherein one of said elongated side walls is formed with relatively deep, outwardly open U-shaped vertical columns extending the full height of the cover body and the opposite elongated side wall is formed with relatively shallow, outwardly open U-shaped vertical columns extending the full height of the cover body, and wherein laterally oriented ones of said reinforcing ribs radiating from said through-holes terminate only at the elongated side wall formed with the relatively shallow U-shaped vertical columns.

8. A valve cover according to claim 7, wherein the relatively deep U-shaped vertical columns are centrally positioned with respect to rocker-arm receiving chambers created by said partition walls and said relatively shallow U-shaped vertical columns are longitudinally aligned with said partition walls.

9. A valve cover according to claim 8, wherein said cast body is a cast aluminum piece, said partitions and reinforcing ribs being unitary cast parts thereof.

10. A valve cover according to claim 1, further comprising means for distributing securing forces applied by said fastening means substantially uniformly along the elongated sealing strip.

11. A valve cover according to claim 10, wherein the means for distributing includes a plurality of reinforcing ribs radiating from each of said through-holes in generally longitudinal and lateral directions with respect to the cover body, said reinforcing ribs having a relatively small height in comparison to the height of said cover body.

12. A valve cover according to claim 11, wherein the means for distributing also includes vertical partition walls extending between the elongated side walls in a manner interconnecting the sidewalls at least at a bottom portion thereof, longitudinally oriented ones of said reinforcing ribs radiating from said through-holes terminating at said partition walls.

13. A valve cover according to claim 12, wherein one of said elongated side walls is formed with relatively deep, outwardly open U-shaped vertical columns extending the full height of the cover body and the opposite elongated side wall is formed with relatively shallow, outwardly open U-shaped vertical columns extending the full height of the cover body, and wherein laterally oriented ones of said reinforcing ribs radiating from said through-holes terminate only at the elongated side wall formed with the relatively shallow U-shaped vertical columns.

14. A valve cover according to claim 13, wherein the relatively deep U-shaped vertical columns are centrally positioned with respect to rocker-arm receiving chambers created by said partition walls and said relatively shallow U-shaped vertical columns are longitudinally aligned with said partition walls.

15. A valve cover according to claim 14, wherein said cast body is a cast aluminum piece, said partitions and reinforcing ribs being unitary cast parts thereof.

16. A valve cover according to claim 6, wherein a pair of said partition walls are spaced closely apart in a manner defining a breather vent chamber that is shielded, in use, from splashing oil, a breather vent aperture being formed in said top wall in communication with said breather vent chamber.

17. A valve cover according to claim 6, wherein a fill port is formed in a portion of said top wall above one of said vertical partition walls, wherein said portion of the top wall is formed with substantially a half-turn of threading at each of opposite sides of said one of the partition walls for receiving a threaded closure cap, and wherein a port spout receiving well is formed in a top portion of said one of the partition walls below said fil port.

18. A valve cover for an internal combustion engine comprising:

a cover body of an inverted trough-like configuration having a top wall, opposed elongated side walls and opposed end walls, a perimetric flange surrounding an open bottom side of the inverted troughlike configuration, and a seal receiving groove formed in a bottom surface of said perimetric flange;

an elastomeric seal inserted within said seal receiving groove so as to form a sealing ridge;

means for mounting the valve cover on a head of an engine comprising a row of through-holes positioned centrally on said top wall of said cover body and threaded fastening means for insertion through each of said through-holes into engagement with the engine head; and means for distributing securing forces applied by said fastening means substantially uniformly around the perimetric flange.

19. A valve cover according to claim 18, wherein an elastomeric O-ring seal is disposed between a head of each of the threaded fastening means the top wall of the cover body is a manner isolating the cover from vibrations transmitted to the threaded fastening means from the engine.

20. A valve cover according to claim 19, wherein said threaded fastening means are should bolts having a shoulder limiting the extent to which they can be tightened and a length coordinated to the height of the cover body for enabling a clearance gap to between the bottom surface of the perimetric flange and a facing surface of the engine head in a fully tightened condition of the bolts.

* * * * *